US011891760B2

(12) United States Patent
Klug et al.

(10) Patent No.: US 11,891,760 B2
(45) Date of Patent: Feb. 6, 2024

(54) RAIL ASSEMBLY FOR RAIL VEHICLES HAVING FLANGED WHEELS

(71) Applicant: Daetwyler Sealing Technologies Deutschland GmbH, Waltershausen (DE)

(72) Inventors: Matthias Klug, Eisenach (DE); Bernd Pahl, Hamburg (DE); Tino Garbe, Wutha-Farnroda (DE); Nicola Klein, Recklinghausen (DE); Andrea Ruedt, Klettgau-Buehl (DE)

(73) Assignee: Daetwyler Sealing Technologies Deutschland Gmbh, Waltershausen (DE)

( * ) Notice: Subject to any disclaimer, the term of this patent is extended or adjusted under 35 U.S.C. 154(b) by 1108 days.

(21) Appl. No.: 16/614,496

(22) PCT Filed: May 22, 2018

(86) PCT No.: PCT/DE2018/200052
§ 371 (c)(1),
(2) Date: Nov. 18, 2019

(87) PCT Pub. No.: WO2018/215033
PCT Pub. Date: Nov. 29, 2018

(65) Prior Publication Data

US 2020/0071884 A1 Mar. 5, 2020

(30) Foreign Application Priority Data

May 23, 2017 (DE) ..... 10 2017 111 298.7

(51) Int. Cl.
*E01B 15/00* (2006.01)
*E01C 9/04* (2006.01)
(Continued)

(52) U.S. Cl.
CPC ..... *E01B 15/00* (2013.01); *E01B 21/00* (2013.01); *E01B 21/02* (2013.01); *E01C 9/04* (2013.01)

(58) Field of Classification Search
CPC ..... E01B 15/00; E01B 21/00; E01B 21/02; E01B 5/10
(Continued)

(56) References Cited

U.S. PATENT DOCUMENTS 71,509,600 12/1902 Leonard
1,034,504 A 8/1912 Pindell
(Continued)

FOREIGN PATENT DOCUMENTS

CN 201751459 U 2/2011
DE 479362 C 7/1929
(Continued)

OTHER PUBLICATIONS

International Search Report dated Nov. 20, 2018, in International Application No. PCT/DE2018/200052.
(Continued)

*Primary Examiner* — Zachary L Kuhfuss
(74) *Attorney, Agent, or Firm* — Patent Central LLC; Stephan A. Pendorf

(57) ABSTRACT

A rail assembly for rail vehicles having flanged wheels, in particular in the area of track covers and track crossings, as well as a profiled filling element therefor. The rail assembly (1) comprises a support structure (7) for a cover (9) which covers the space (8) directly alongside the rail (2), the cover (9) acting as a guide rail and being easy to remove from the support structure (7). Also disclosed is a profiled filling element (200, 220) particularly suitable for the rail assembly (1).

18 Claims, 8 Drawing Sheets

(51) Int. Cl.
*E01B 21/02* (2006.01)
*E01B 21/00* (2006.01)

(58) Field of Classification Search
USPC ..... 238/8
See application file for complete search history.

(56) References Cited

U.S. PATENT DOCUMENTS

| | | | | |
|---|---|---|---|---|
| 1,037,716 | A | 9/1912 | Aston | |
| 1,038,969 | A | 9/1912 | Ryan | |
| 1,054,852 | A | 3/1913 | Leeo | |
| 1,130,997 | A | 3/1915 | Newhall | |
| 1,329,789 | A * | 2/1920 | Mallett | E01B 15/00 238/379 |
| 1,349,451 | A | 8/1920 | Godwin | |
| 4,203,547 | A | 5/1980 | van der Harst | |
| 6,293,473 | B1 | 9/2001 | Ortwein et al. | |
| 7,661,640 | B2 | 2/2010 | Persson | |
| 2007/0278322 | A1 | 12/2007 | Suess | |
| 2015/0191876 | A1* | 7/2015 | Pahl | E01B 9/02 238/121 |

FOREIGN PATENT DOCUMENTS

| | | | | |
|---|---|---|---|---|
| DE | 499056 | C | 5/1930 | |
| DE | 564508 | C | 11/1932 | |
| DE | 608258 | C | 1/1935 | |
| DE | 812674 | C | 9/1951 | |
| DE | 1976647 | U | 1/1968 | |
| DE | 2812550 | A1 | 10/1978 | |
| DE | 8707445 | U1 | 9/1987 | |
| DE | 29509395 | U1 | 8/1995 | |
| DE | 19801583 | A1 | 7/1999 | |
| DE | 19859708 | C1 | 5/2000 | |
| DE | 10011468 | B4 | 5/2004 | |
| DE | 10302521 | A1 | 8/2004 | |
| DE | 202005004107 | U1 | 6/2005 | |
| DE | 102004018914 | A1 | 10/2005 | |
| DE | 202004017132 | U1 | 3/2006 | |
| DE | 102004054794 | B3 | 4/2006 | |
| DE | 102005003962 | A1 * | 8/2006 | E01B 21/02 |
| DE | 102005003962 | A1 | 8/2006 | |
| DE | 102017122770 | A1 | 3/2018 | |
| EP | 0830480 | A1 | 3/1998 | |
| EP | 0830480 | B1 | 7/2000 | |
| EP | 1462570 | A1 | 9/2004 | |
| EP | 2175069 | A2 | 4/2010 | |
| EP | 2298991 | A1 | 3/2011 | |
| EP | 2589703 | A2 | 5/2013 | |
| WO | 2014008890 | A2 | 1/2014 | |

OTHER PUBLICATIONS

Chinese Office Action (with English language translation) dated Oct. 21, 2020, in Chinese Application No. 201880034555.4.

* cited by examiner

RAIL ASSEMBLY FOR RAIL VEHICLES HAVING FLANGED WHEELS

The invention relates to a rail assembly for rail vehicles having flanged wheels, in particular in the region of track covers and track crossings, as well as to a profiled filling element for the rail assembly.

Rail routes that run in regions that are also used by other vehicles, such as motor vehicles and bicycles, or pedestrians, must meet specific requirements with regard to the transition to the cover adjacent to the rails, such as that of a road or a track crossing. This applies, for example, to the case of tram tracks installed in or on roads used by motor vehicles, bicycles and pedestrians, but also to main or secondary tracks, for example in the vicinity of track crossings.

On such rail routes, grooved rails with a running rail, a guide rail, and a groove in between are often used, wherein the groove accommodates the flange of a flanged wheel of rail vehicles equipped with the latter, e.g. trams, and the guide rail serves primarily to provide derailment protection, and protection against an inadvertent narrowing of the groove, for example when driven over by road vehicles. Grooved rails are of known art, for example, from DE 102004018914 A1, DE 102004054794 B3, DE 202004017132 U1, DE 202005004107 U1, DE 479362, DE 499056, DE 608258, DE 812674, DE 564508 and EP 1462570 A1.

However, the groove is a potential source of danger for road users, such as cyclists, whose tyres can get caught in the groove, or also for pedestrians, such as women with high heels, or elderly people. Efforts have therefore already been made in the prior art to at least minimise the risks presented by the groove. In EP 2298991 A1, for example, it has been proposed to bond a protective insert, consisting preferably of plastic, e.g. foamed polyurethane, adhesively into the groove. From DE 8707445 U1 it is also of known art to fix a profiled filling element of a rubber or rubber-like material in the groove by means of retaining lips and adhesive bonding. In WO 2014/008890 A2 it has also been proposed to arrange a profiled filling element in the groove, which element has a part A facing the rail head and a part B facing the rail foot, wherein the part B facing the rail foot is elastically deformable, and the part A facing the rail head has a greater hardness and/or strength than the part B facing the rail foot.

In addition to safety aspects, the ability to maintain rail assemblies in the region of track covers and track crossings also plays an important role. It is therefore desirable to configure rail assemblies in the said region such that regular maintenance, for example cleaning tasks, repairs and renewals, can be carried out as easily, quickly, and in an uncomplicated manner, as possible. It would moreover be desirable if grooved rails, which are relatively complex to manufacture and require intensive maintenance, could be dispensed with.

U.S. Pat. No. 1,034,504 A describes a rail assembly in the region of track covers or track crossings, which comprises a rail of the Vignol type, and has a structure alongside the rail, which serves to reinforce the edge region of the cover adjacent to the rail, and at the same time replicates a groove. Rail flanking structures in the region of track covers or rail crossings, which comprise rails of the Vignol type and replicate a groove, are also of known art from U.S. Pat. Nos. 766,164 A and 1,054,852 A. The structure described in U.S. Pat. No. 1,054,852 A is also intended to facilitate the maintenance of the rail assembly.

DE 19801583 A1 and DE 19859708 C1 describe structures arranged alongside a Vignol rail, which perform the function of the groove or the guide rail of a grooved rail.

From EP 2589703 A2 a rail drainage box for grooved rails is of known art, in which a front edge of the box cover directed towards the track groove is designed as a track guide for the guide rail.

DE 10011468 B4 and EP 0830480 describe guide devices for grooved rails in the region of points, in which parts of the device assume the guide rail function.

There is still a need to improve the cost, maintenance, repair and safety aspects of rail routes for rail vehicles with flanged wheels in the region of, for example, track covers and crossings.

The object of the present invention is therefore to provide a rail assembly for rail vehicles with flanged wheels in the region of, for example, track covers and track crossings, which can be safely driven on by other road users, such as motor vehicles and bicycles, but which is comparatively inexpensive and easy to maintain or repair.

This object is achieved by means of the subject matter of the independent claims. Advantageous embodiments of the invention are specified in the dependent claims.

The invention provides a rail assembly for rail vehicles with flanged wheels, wherein the rail assembly comprises the following:

a) at least one rail of the Vignol type with a rail head having a running surface for a flanged wheel, a rail web, and a rail foot b) a support structure, flanking the rail laterally, in the longitudinal direction of the rail, for a cover that covers the space directly alongside the rail, which:

aa) is detachably connected to the support structure such that in the installed state the cover can be reversibly removed from the support structure, bb) has an essentially horizontal surface, which is essentially flush with the running surface of the rail head, and cc) has an edge region directed towards the rail, which forms a guide rail.

c) an angled profile, which is generally L- or J-shaped in cross-section, and is fixedly connected to the cover, or is formed integrally with the latter, wherein the angled profile has a first leg extending in the direction of the rail foot, and a second leg extending in the direction of the rail web, wherein the support structure, the cover, and the angled profile, are not attached to the rail.

The inventive rail assembly is comparatively simple in construction, and, since it does not need to be attached to the rail, does not require any special configuration of, or modifications to, an existing rail, for example the drilling of holes in the rail web. The assembly can be laid together with the rail, or retrospectively. It is easy to clean, for example, it can also be cleaned by machine. The deployment of a grooved rail or other track guidance devices attached to the rail is not necessary, since the cover and the generally L- or J-shaped angled profile that is attached to the latter assume the function of the groove and the guide rail, that is to say, the track guidance. The cover is detachably attached to the support structure, for example it is bolted on, and can be removed as required, for example, for maintenance or repair purposes, so as to allow access to the space located under the cover next to the rail. Since the generally L- or J-shaped angled profile is fixedly connected to the cover, it can be reversibly removed from the support structure together with the cover. The rail thus becomes completely accessible in a simple manner, so that the invention also facilitates mechanical rail grinding (reprofiling).

In particular, in the case of embodiments in which a suitable profiled filling element is arranged in the replicated groove, the inventive rail assembly can also be safely negotiated or driven on by other vehicles, in particular motor vehicles and bicycles, and can also be safely walked on by pedestrians. In addition, the profiled filling element, together with the cover, can be removed from the support structure. This is particularly easy in embodiments in which the profile is attached in a suitable manner to the angled profile.

The term "rail of the Vignol type" includes, in addition to Vignol rails, crane rails, and refers to rails with a rail foot, a rail web, and a rail head that does not have a groove serving as a channel for the flange of a flanged wheel. The term also includes grooved rails, or regions of grooved rails, in which the guide rail, and thus the groove, have been technically removed, for example by milling.

The term "generally L- or J-shaped angled profile" includes isosceles or non-isosceles angled profiles, wherein the legs do not necessarily have to be at an exact right angle to one another, and can also run in the form of a curve. When reference is made here to a leg of the L- or J-shaped angled profile extending in the direction of the rail foot, this refers to a section of the angled profile extending essentially vertically, or parallel to the rail web, whereas when reference is made to a leg of the L- or J-shaped angled profile extending in the direction of the rail web, this refers to a section of the angled profile which is essentially horizontal, possibly designed in the form of a curve, and oriented towards the rail.

The term "reversibly removable" in relation to the cover means that the cover can essentially be removed non-destructively, and can be reattached in its original position. This can mean, for example, that the cover is simply laid in position and is essentially unattached. Preferably, however, this means that the cover can be attached to the support structure by means of a screw-form fitting, for example, and at a later date can again be detached from it. "Essentially non-destructively" in this context means that neither the support structure nor the cover is damaged when the cover is removed. The term "reversibly removable" therefore also includes the case in which the cover is attached to the support structure by means of an adhesive, which must be renewed when the cover is reattached.

The expression according to which the cover "has an edge region facing the rail, which forms a guide rail" means that the cover is formed in its edge region facing the rail such that the cover here replicates a guidance device in the form of a guide rail, that is to say, it functions as a kind of guide rail as would otherwise be part of a grooved rail. For this purpose, the cover can have a straight or bevelled edge on its edge facing the rail, along which a flanged wheel can be guided with the flange. The term "guide rail" (also referred to as check rail, auxiliary rail or catch rail) refers to a guide that normally runs inside the running rails of a track, and is a component of a grooved rail.

The term "profiled filling element" refers to a preferably elastically deformable profile that can be inserted into a groove or a groove-like structure. With regard to its material and elastic properties, a profiled filling element is preferably configured such that it has suitable damping properties, i.e. it is elastically deformed when subjected to load as the flange drives over, and at the same time is deformed as little as possible by motor vehicles, bicycles, etc. as they drive or ride over.

In a preferred embodiment, the inventive rail assembly comprises a strand-shaped profiled filling element, wherein the profiled filling element is arranged on the second leg extending in the direction of the rail web. "strand-shaped" means that the profiled filling element forms an elongated profile strand so that it can be laid parallel to a rail.

In a preferred embodiment the surface of the profiled filling element is essentially flush with the running surface of the rail head. This creates an essentially flat surface next to the rail, so that bicycles, for example, are not caught in the groove with their wheels.

The profiled filling element is preferably attached to the generally L- or J-shaped angled profile, for example by a screw-form fitting or the use of adhesive.

The profiled filling element is particularly preferably of a generally L- or J-shaped cross-section, and has a first profile leg extending in the direction of the rail foot and a second profile leg extending in the direction of the rail web, wherein the first profile leg contains at least one hollow channel extending in the longitudinal direction of the strand-shaped profiled filling element, which hollow channel is surrounded by profile material transversely to the longitudinal direction of the strand-shaped profiled filling element, and the second profile leg of the profiled filling element is of solid construction and forms a profiled filling element base. "Solid" in this context means that no hollow channels are present, but rather that the profile leg is made of a solid material. The first and second profile legs are preferably made of the same, preferably elastomeric, material, but can also be made of different materials. The second profile leg forming the profile base is preferably harder, i.e. less elastically deformable, than the first profile leg, which deforms elastically in the vertical direction when driven over by a flanged wheel, but then returns into its initial position. The part of the first profile leg that is located at its free end, and is most exposed to wear as a result of flanged wheels driving over it, can be coated or reinforced as necessary. The second leg of the profile preferably extends over the entire width of the groove in this region and lies completely on the second leg of the angled profile.

In a preferred embodiment of the inventive rail assembly, the support structure has a rear wall extending essentially parallel to the longitudinal direction of the rail, and transverse walls directed transversely to the rear wall in the direction of the rail, and arranged at intervals from one another. The support structure is preferably arranged on a base plate, which can, for example, consist of metal, e.g. steel, and is preferably attached by means of welded joints. Ribbed plates for purposes of rail attachment, for example, can also be arranged on this base plate. The support structure can have openings or perforations, preferably in the transverse walls and/or in the base region. This facilitates mechanical cleaning and dewatering.

In another preferred embodiment of the inventive rail assembly, the support structure has a drainage fitting. This is preferably located in the region of the base of the support structure, and enables an efficient drainage or extraction of water, for example in the event of heavy rainfall or cleaning.

The cover can, for example, be a metal plate, which preferably has openings, so as to attach the cover to the support structure by means of suitable attachment devices, e.g. screw-form fittings, and to prevent water deposits.

The invention also provides a profiled filling element for an inventive rail assembly, wherein the profiled filling element has an strand-shaped form and generally has an L- or J-shaped cross-section, and wherein a first profile leg includes at least one hollow channel extending in the longitudinal direction of the strand-shaped profiled filling element and surrounded by profile material transversely to the longitudinal direction of the strand-shaped profiled filling element, and a second profile leg of the profiled filling element is of solid construction. The solid second profile leg preferably serves as the profile base.

In a preferred embodiment of the inventive profiled filling element, the first leg has a section with a protrusion which protrudes in the direction in which the second leg of the profile extends, wherein at least part of the at least one hollow channel is located in the section with the protrusion. "Protrusion" here means in particular that the protrusion extends beyond an imaginary vertical, dropped from the protrusion-side corner of the free end of the first profile leg onto the second profile leg.

In another preferred embodiment of the inventive profiled filling element, the section with the protrusion is arranged such that in the installed state the protrusion can be brought into engagement with the underside of the rail head of a Vignol-type rail. This is particularly advantageous because the profiled filling element can thereby be held in the installed position without additional fixing. In particular, the protrusion is located at a distance from the free end of the first profile leg corresponding to, or slightly exceeding, the rail head height of a Vignol-type rail.

In a preferred embodiment, the profile material laterally surrounding the at least one hollow channel in the first profile leg forms a first lateral profile leg wall facing the side with the second profile leg, and an opposing second lateral profile leg wall, wherein the cross-section of the first lateral profile leg wall runs in a zigzag-shape such that the protrusion is thereby formed, wherein the inner wall surfaces of the at least one hollow channel lying towards the first lateral profile leg wall in the section with the protrusion extend essentially parallel to the outer wall surfaces of the first lateral profile leg wall, such that the first lateral profile leg wall in the section with the protrusion has the same wall thickness, that is to say, essentially a uniform wall thickness.

In another preferred embodiment, a single hollow channel is arranged in the first profile leg such that the wall part located at the free end of the first profile leg has a greater wall thickness than the first lateral profile leg wall, the second lateral profile leg wall also has a zigzag-shape in cross-section, and the inner wall surfaces of the one hollow channel in the section with the protrusion extend essentially parallel to the respective outer wall surfaces of the first and second lateral profile leg walls, such that the first and second lateral profile leg walls in the section with the protrusion have essentially a respectively uniform wall thickness.

It is particularly preferable for the profiled filling element to be generally L-shaped in cross-section.

Furthermore, it is preferable for the profiled filling element to consist of an elastomeric material. Suitable elastomeric materials are, for example, those based on styrene-butadiene rubber (SBR), natural rubber (NR), a natural rubber-butyl rubber mixture (NR/BR), or ethylene-propylene-diene copolymer (EPDM). The two profile legs can be formed from the same or different materials. It is also possible for a profile leg to consist of different materials. For example, the wall region located at the free end of the first profile leg can comprise a harder material, e.g. a metal, or can be coated, for example with a PTFE layer.

In what follows the invention is explained in more detail with the aid of the figures, appended purely for illustrative purposes.

Figure 1:
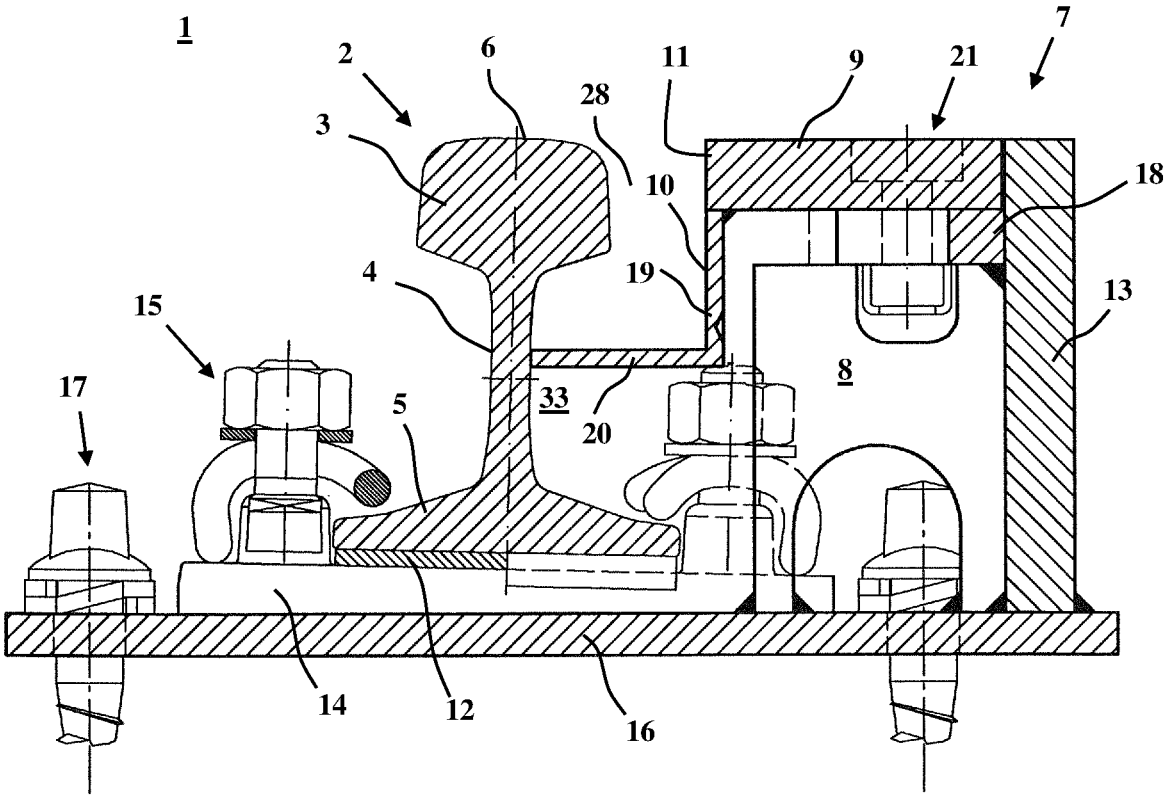
FIG. 1 shows a cross-section through an embodiment of an inventive rail assembly.

FIG. 1 shows a cross-section through an embodiment of an inventive rail assembly 1. The rail assembly 1 comprises a rail 2 of the Vignol type, with a rail head 3 having a running surface 6, a rail web 4, and a rail foot 5. The rail 2 is here arranged on a ribbed metal plate 14. Between the underside of the rail foot 5 and the ribbed plate 14 there is arranged an insulation layer 12, which can consist of a plastic polymer, for example. The surface of the ribbed plate 14 has a slight inclination, so that the rail 2 arranged on it is also slightly inclined. If the rail 2 is part of a track, it is slightly inclined towards the inside of the track. The rail 2 is fixed to the ribbed plate 14 in the usual manner by means of tension clamps 15. The ribbed plate 14 is here fixed, for example welded, onto a base plate 16. The base plate 16 has attachment devices 17, with the aid of which it can be attached, e.g. securely bolted, to a suitable surface, for example railway sleepers. The right-hand side of the figure shows a support structure 7, flanking the rail in the longitudinal direction, which comprises a metal rear wall 13 running in the longitudinal direction of the rail, with supports 18 welded to it and directed towards the rail 2. The support structure 7 also comprises transverse metal walls 25 (see FIGS. 5A, B; FIG. 6), which are welded to the rear wall 13 and extend transversely to the longitudinal direction of the rails in the direction of the rail 2. Within a track, the support structure 7 would preferably flank the rail 2 on the inside of the track. The support structure 7 serves to support a flat metal cover 9, which is configured such that it can be driven on by, for example, motor vehicles. The cover 9 here lies on the supports 18 together with the transverse walls 25, and is reversibly attached by means of mounting flanges 26 provided on the transverse walls 25 (see FIG. 5A) with appropriate attachment devices 21, for example by means of screw-form fittings. The cover 9 covers the space 8 directly alongside the rail 2. The upper surface of the cover 9 is essentially flush with the running surface 6 of rail 2, and has an edge region 11 directed towards the rail 2, which forms a guide rail, that is to say, it assumes the function of the guide rail of a grooved rail. In the edge region 11 of the flat cover 9, an angled metal profile 10, L-shaped in cross-section, is fixedly attached, for example welded, onto the underside of the cover. The L-shaped angled profile 10 comprises a first leg 19, which is essentially vertical and extends towards the rail foot 5, and a second leg 20, which is essentially horizontal and extends towards the rail web 4. The second leg 20 is arranged in the region of the rail web 4, i.e. the free end of the second leg 20 lies below the height of the underside of the rail head 3, and above the rail foot 5, wherein the free end of the second leg 20 preferably lies within the rail chamber 33 bounded by the underside of the rail head 3, the rail web 4 and the top of the rail foot 5. The free end of the second leg 20 can reach as far as the rail web 4 and even touch it, or can be spaced apart from the rail web 4. Together with the edge region 11, the legs 19, 20 of the angled profile 10, together with the lateral flanks of the rail 2, form a groove 28, in which, for example, a profiled filling element 100, 200, 220 can be arranged. The cover 9 is fixedly connected to the angled profile 10 and can, together with the angled profile 10, and, if necessary, the profiled filling element 100, 200, 220, be removed from the support structure 7, for example so as to carry out maintenance or repair tasks.

Figure 2:
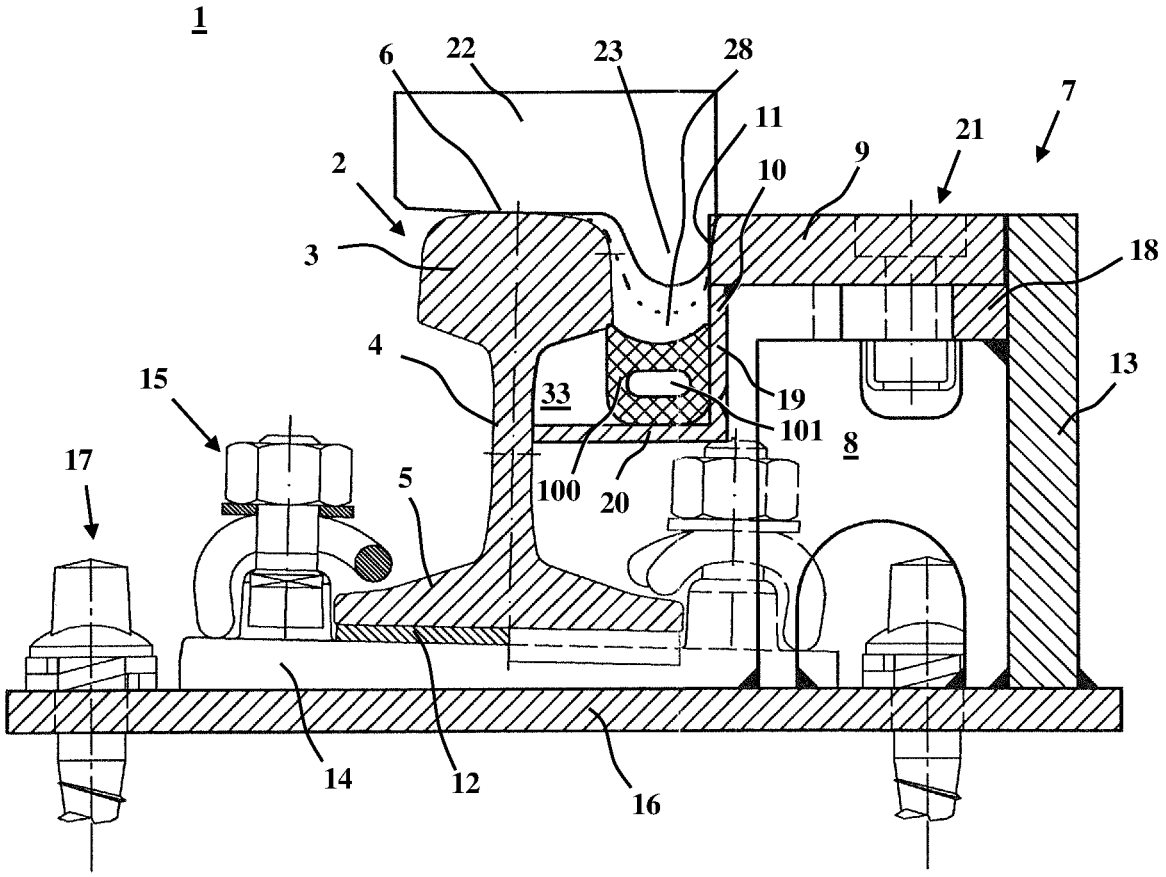
FIG. 2 shows a cross-section through the embodiment shown in FIG. 1 of an inventive rail assembly, with a profiled filling element.

FIG. 2 shows a cross-section through the embodiment shown in FIG. 1 of an inventive rail assembly 1, with a strand-shaped profiled filling element 100, which is arranged on the second leg 20 of the angled profile 10 and here simply performs the function of replicating the groove floor of a conventional groove rail, and filling the space between the angled profile 10 and the rail 2. The profiled filling element 100 has a hollow channel 101 running in the longitudinal direction of the strand-shaped profiled filling element 100. In this figure part of a flanged wheel 22 with a flange 23 is drawn for purposes of illustration. The dashed line indicates the limits of a flange 23 protruding further into the groove 28 as a result of wear of the rail head 3.

Figure 3:
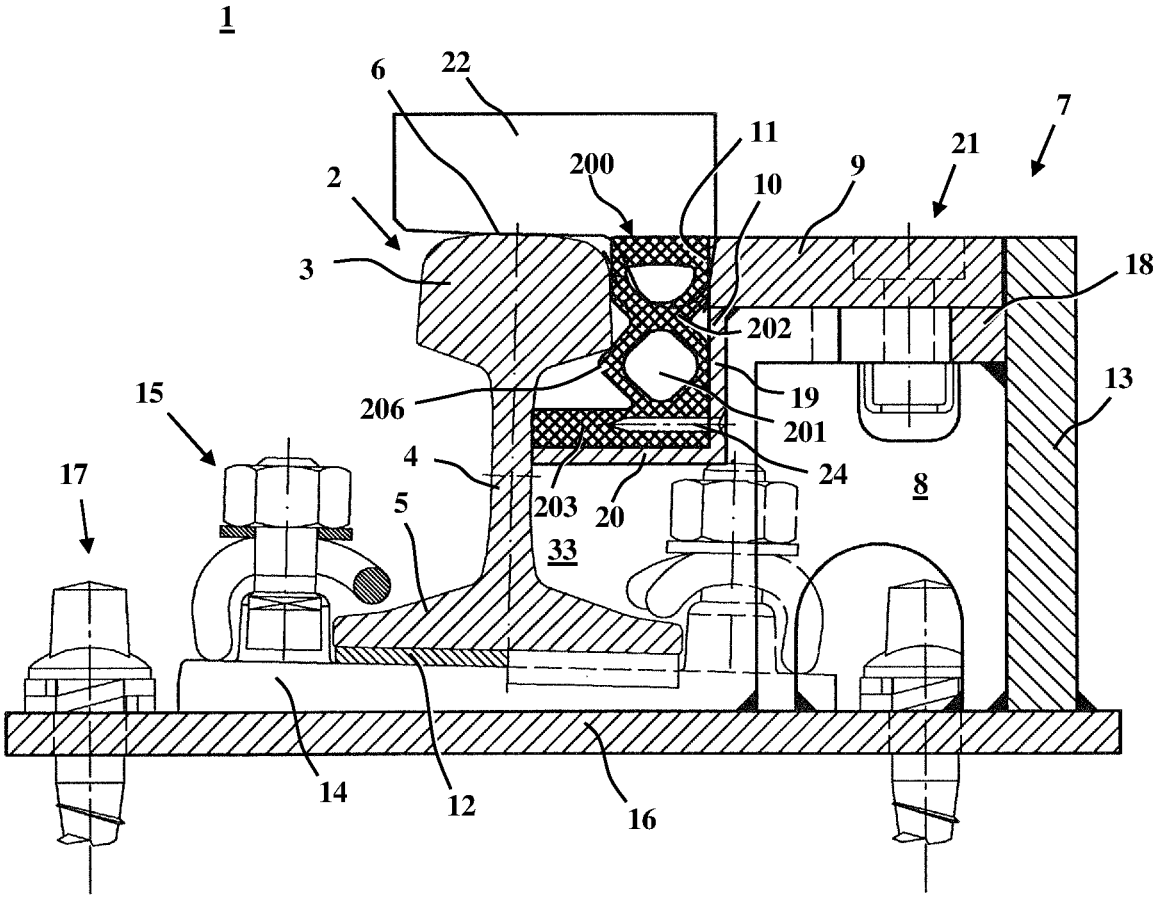
FIG. 3 shows a cross-section through the embodiment shown in FIG. 1 of an inventive rail assembly, with a further profiled filling element.

FIG. 3 shows a cross-section through the embodiment shown in FIG. 1 of an inventive rail assembly 1, with a further strand-shaped profiled filling element 200. The profiled filling element 200 is generally L-shaped in cross-section and has a first profile leg 202 extending essentially vertically in the direction of the rail foot 5 and in the direction of the open end of the groove 28, respectively, and a second profile leg 203 extending essentially horizontally. Here the first profile leg 202 has two hollow channels 201 and is elastically deformable, such that the profile leg 202 is elastically deformed in the vertical direction as the flange 23 drives past, while the second profile leg 203 is designed as a solid profile base and is not, or only slightly, elastically deformable in comparison to the first profile leg 202. The second profile leg 203 is arranged on the second leg 20 of the angled profile 10, while the first profile leg 202 of the profiled filling element 200 rests on the first leg 19 of the angled profile 10 on the one hand, and on the lateral flank of the rail head 3 facing the groove 28 on the other hand. The first profile leg 202 has a zigzag-shaped cross-section in a section 204 (see FIG. 7A). Here the profile leg 202 has an angularly-shaped protrusion 206 located at the height of, or just below, the underside of the rail head 3, whereby the cross-section of the profile leg 202 is widened so that the profile leg 202 is wider at this location than the groove 28 in the region of the rail head 3, and the protrusion 206 is in engagement with the underside of the rail head 3. In this manner, the profiled filling element 200 is held in the groove 28 without additional fixing. In this section a hollow channel 201 with inner wall surfaces 209, 210 (see FIG. 7A) is configured in cross-section as a square or a diamond-shape standing on a point, while a second hollow channel 201 located above it is generally semicircular in cross-section, with an inner wall lying essentially horizontally or slightly curved towards the open end of the profile leg 202. The profile material laterally surrounding the lower hollow channel 201 in the first profile leg 202 forms a first lateral profile leg wall 207 facing towards the side with the second profile leg 203 with an outer wall surface 211, and an opposing second lateral profile leg wall 208 with an outer wall surface 212 (see FIG. 7A). The lateral profile leg wall 207 facing the rail 2 has an essentially uniform wall thickness in the section 204 with the protrusion 206. The solid part 205 at the upper free end of the profile leg 202 has a greater wall thickness than the lateral profile leg wall 207 located below. The profiled filling element 200 is attached to the angled profile 10 by means of a screw 24 running through the first leg 19 of the angled profile 10 and projecting into the second, solid profile leg 203 of the profiled filling element 200. The second profile leg 203 is as wide in cross-section as the groove 28 and fills the latter in this region.

Figure 4:
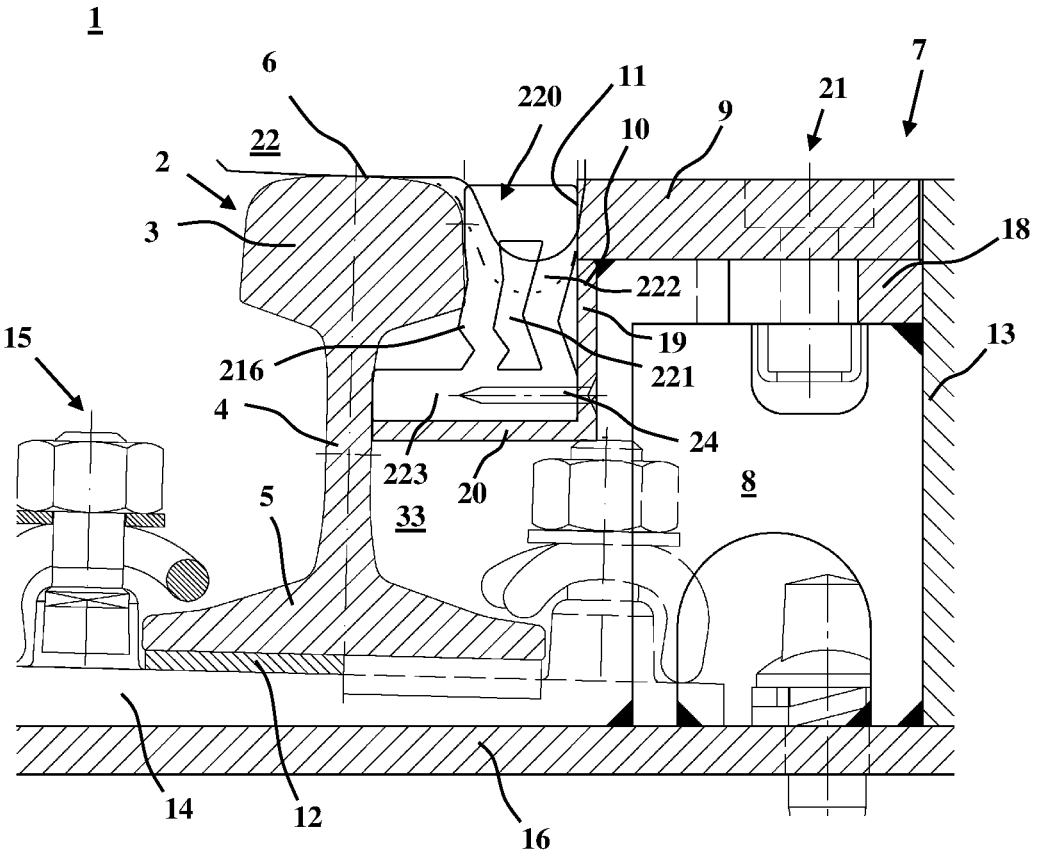
FIG. 4 shows a cross-section through the embodiment shown in FIG. 1 of an inventive rail assembly, with a further profiled filling element.
Figure 7A:
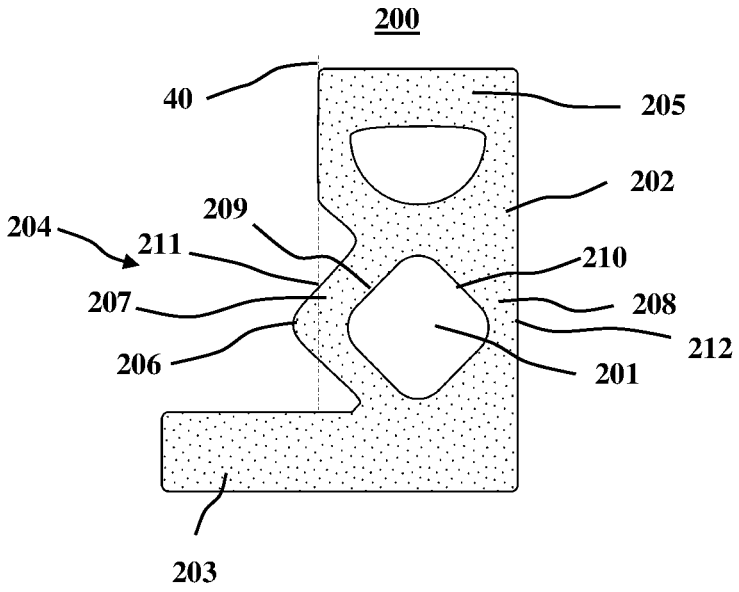
FIG. 7 shows a cross-section through an embodiment of a profiled filling element for an inventive rail assembly.
Figure 7B:
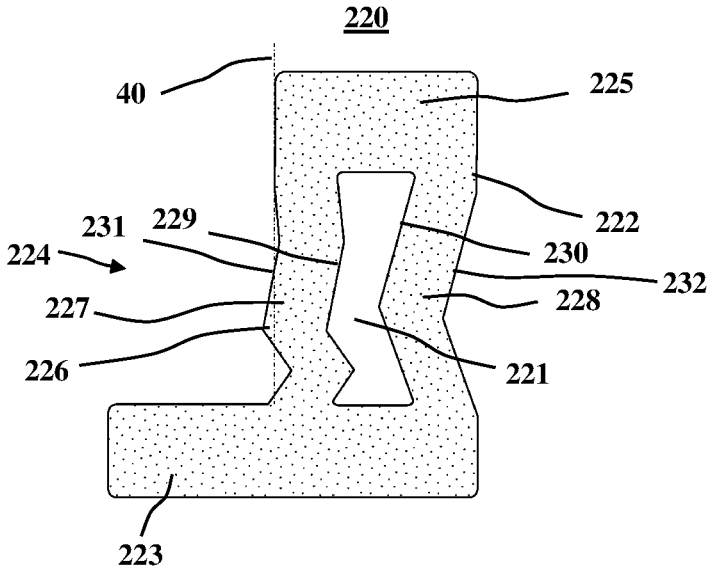

FIG. 4 shows a cross-section of the embodiment shown in FIG. 1 of an inventive rail assembly 1 with a further strand-shaped profiled filling element 220 (for details see also FIG. 7B). This profiled filling element 220 is also generally L-shaped in cross-section and has a first profile leg 222 extending essentially vertically towards the rail foot 5 or towards the open end of the groove 28, and a second profile leg 223 extending essentially horizontally. The first profile leg 222 has only one hollow channel 221 and is elastically deformable, particularly in the direction of the groove floor, while the second profile leg 223, which forms the profile base, is of solid construction, and is comparatively hard and less elastically deformable. Here, too, the second profile leg 223 extends over the entire groove cross-section. The profiled filling element 220 is fixed to the angled profile 10 by means of a screw 24 screwed into the second profile leg 223, and can be removed, together with the cover 9 and the angled profile 10, in one step, so as to make the space 8 accessible alongside the rail 2. In this profiled filling element 220, both profile leg walls 227, 228 laterally surrounding the hollow channel 221 are zigzag-shaped in the section 224, with the protrusion 226 (see FIG. 7B). The protrusion 226 formed in the first profile leg wall 227 extends in the direction of the rail 2 and engages with the underside of the rail head. The single hollow channel 221 is designed such that its lateral inner surfaces 229, 230 run essentially parallel to the respective lateral outer wall surfaces 231, 232 of the profile leg walls 227, 228, so that the lateral profile leg walls 227, 228 of the profiled filling element 220 have a essentially uniform wall thickness in the region of the hollow channel 221. The solid part 225 of the profile leg 222 located at the upper free end has a greater wall thickness than the lateral profile leg walls 227, 228 located underneath.

Figure 5A:
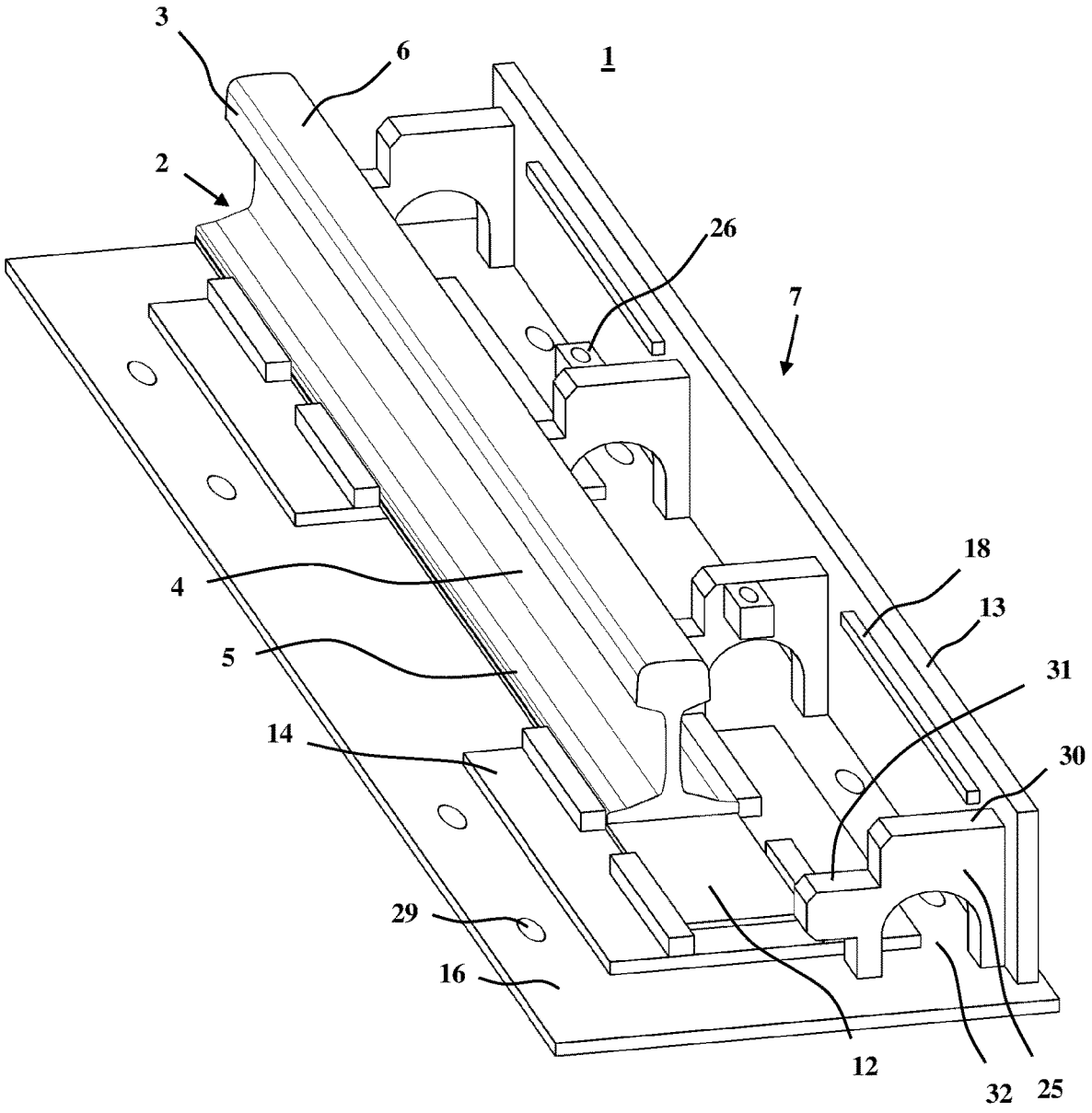
FIG. 5 shows a simplified spatial representation of an embodiment of an inventive rail assembly, (A) with cover, and (B) without cover.
Figure 5B:
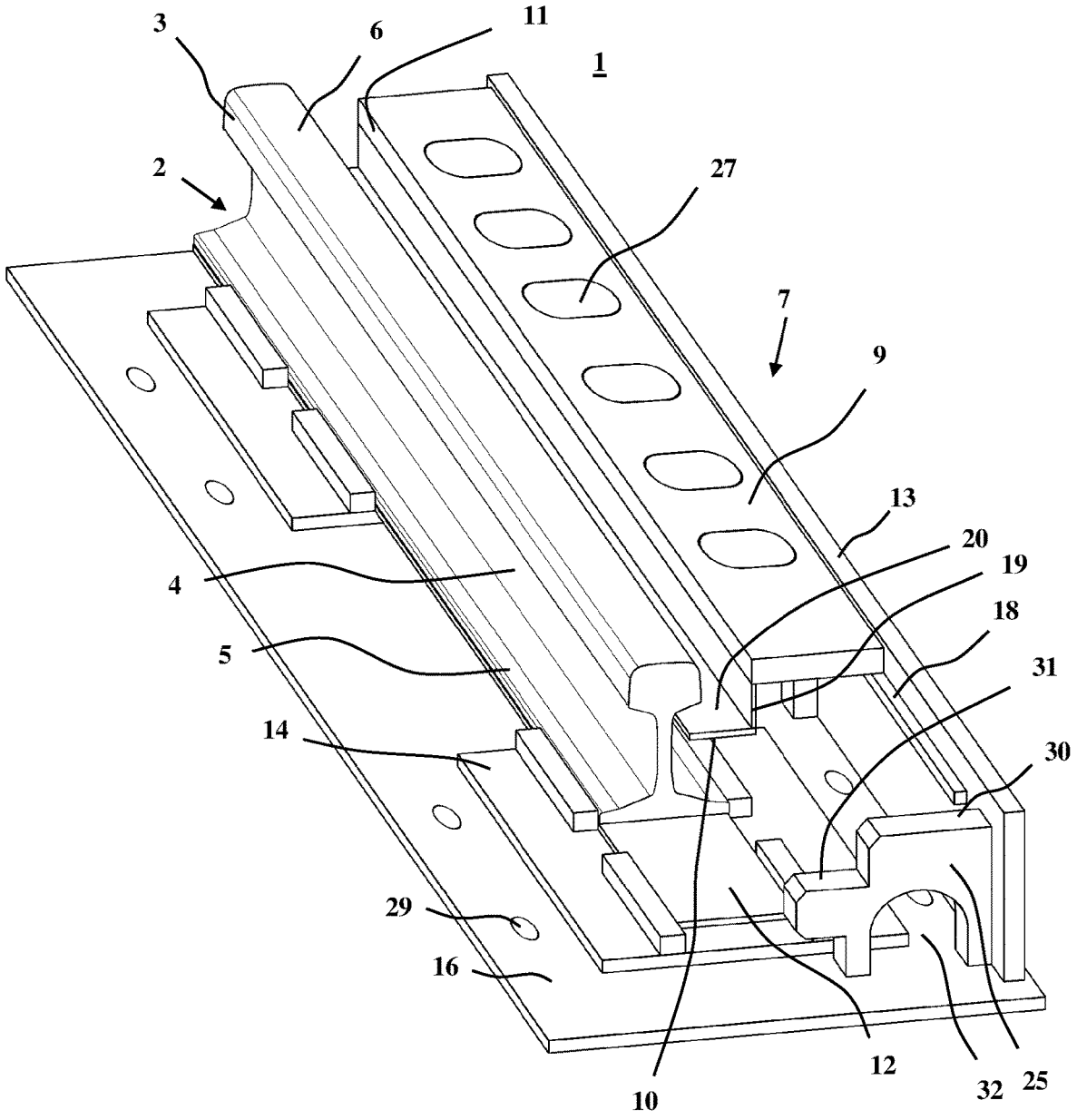
Figure 6:
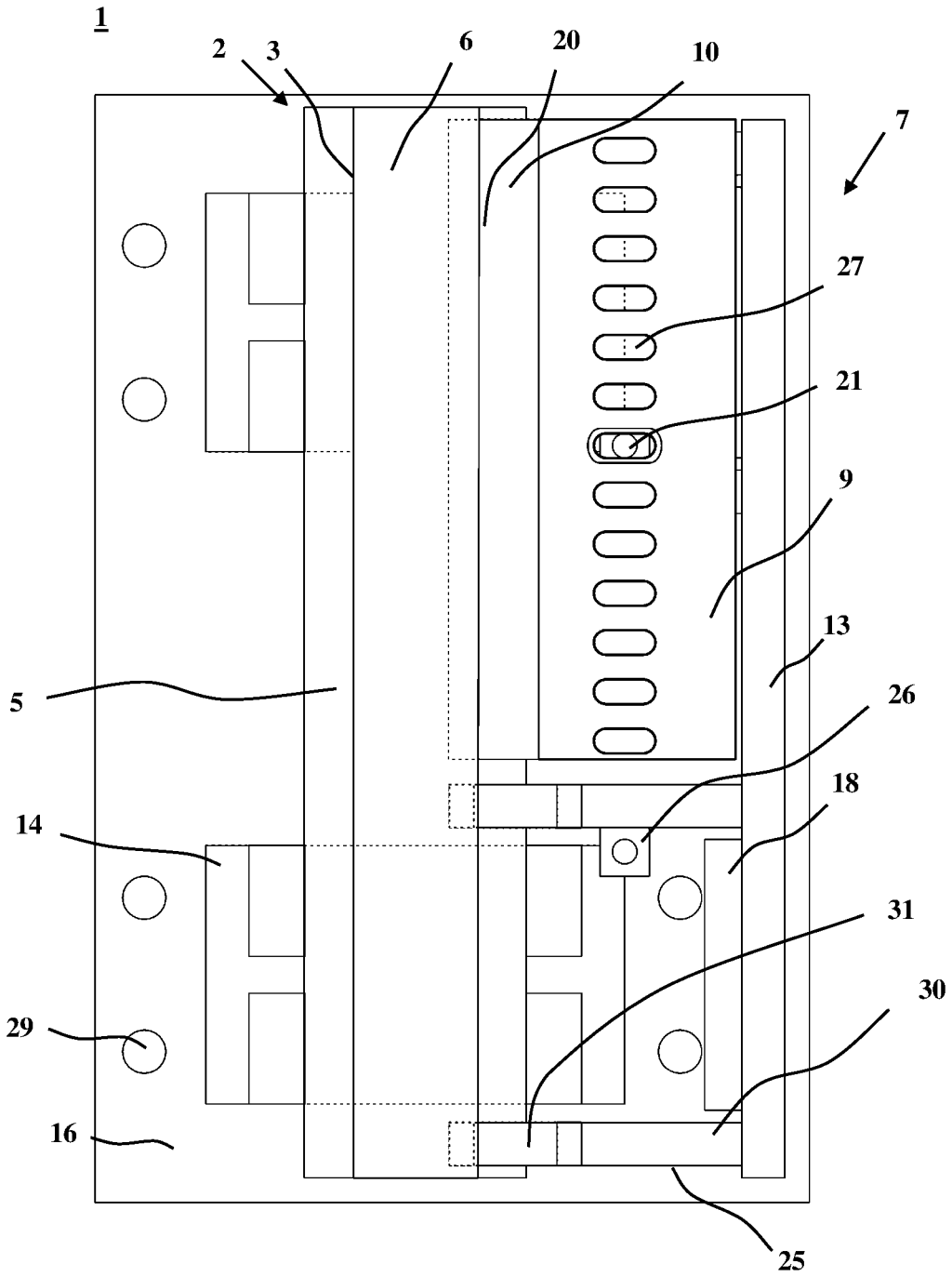
FIG. 6 shows a simplified plan view onto an embodiment of an inventive rail assembly.

FIG. 5 shows a simplified spatial view of an inventive rail assembly 1. FIG. 5A shows the support structure 7 without the cover 9, while FIG. 5B shows the support structure 7 with the cover 9. The tension clamps 15 are not shown here, so as to provide a better overview, neither are the attachment devices 17 of the base plate. Just the holes 29 provided for this purpose are shown here. Only one section of the rail 2 is shown. FIG. 5B also shows only one section of a cover 9 so as to provide a better overview. This view shows transverse walls 25, extending from the rear wall 13 in the direction of the rail 2, and providing upper support surfaces 30, on which the cover 9 can be laid in position. If required, the second leg 20 of the angled profile 10 can be positioned on the lower support surfaces 31 of the transverse walls 25. However, this is not absolutely necessary, since the angled profile 10 is already attached, e.g. welded, to the support, and only has to absorb as a maximum the forces exerted by a profiled filling element 100, 200, 220 as the flanged wheel 22 drives over. The transverse walls 25 have openings 32, which, for example, serve to allow the drainage of water. Mounting flanges 26 on two transverse walls 25 are provided here for purposes of attaching the cover 9, by means of which the cover 9 can be reversibly attached by means of suitable attachment devices 21, e.g. screw-form fittings. Here the cover 9 has openings 27, which can be used not only to attach the cover 9 to the support structure 7 by means of attachment devices 21, but also to drain water from the inside of the track. The base plate 16 can have openings (not shown here) for purposes of draining or extracting water into the ground.

FIG. 6 shows a simplified plan view onto a form of embodiment of an inventive rail assembly 1. In the lower part of the figure, the cover 9 has been omitted so as to provide a better overview. Here, too, the ribbed plates 14 are shown without the tension clamps 15 and just the holes 29 for the attachment devices of the base plate 16. In other respects, so as to avoid unnecessary repetitions, reference is made to the description of FIGS. 1 to 5.

FIGS. 7A and 7B show embodiment of an inventively configured profiled filling element 200, 220. The profiled filling element 200 shown in FIG. 7A has already been described with reference to FIG. 3, and the profiled filling element 220 shown in FIG. 7B has already been described with reference to FIG. 4, so that here too reference is made back to these descriptions. Both profiled filling elements 200 and 220 are made of an elastomeric material and have a strand-shaped form. They have a generally L-shaped cross-section, wherein a first profile leg 202, 222 contains at least one hollow channel 201, 221 running in the longitudinal direction of the strand-shaped profiled filling element 200, 220, which is surrounded transversely to the longitudinal direction of the strand-shaped profiled filling element 200, 220 by profile material. The hollow channel 201, 221 can be open to the end faces of the strand-shaped profiled filling element 200, 220, but is laterally surrounded by profile material, such that a first profile leg wall 207, 227 and a second profile leg wall 208, 228 are formed. A second profile leg 203, 223 is of solid construction and forms a comparatively hard profile base, which is less elastically deformable in comparison to the first leg 202, 222. The first, more elastically deformable leg 202, 222 runs essentially vertically in the intended installed state, while the second, less elastically deformable leg 203, 223 runs essentially horizontally. The profiled filling elements 200, 220 each have a protrusion 206, 226 in the direction in which the second leg 203, 223 also runs, which protrudes horizontally beyond an imaginary vertical 40, which is dropped from the upper left-hand corner of the profiled filling element 200, 220 in the figure onto the second profile leg 203, 223. For both profiled filling elements 200, 220, in each case the profile of the outer wall surfaces 211, 231 of the first profile leg 202, 222 in the section 204, 224 with the protrusion 206, 226 essentially follows the contour of the hollow channel 201, 221 located inside the said section 204, 224. In the case of the profiled filling element 220 shown in FIG. 7B, the same also applies to the outer wall surfaces 232 of the second profile leg 222.

The invention claimed is:

1. A rail assembly (1) for rail vehicles with flanged wheels (22), comprising:

a) at least one rail (2) of the Vignol type with a rail head (3), having a running surface (6) for a flanged wheel (22), a rail web (4) and a rail foot (5), the rail (2) being part of a track, b) a support structure (7), flanking the rail (2) laterally in the longitudinal direction of the rail and on the side of the rail (2) on the inside of the track, for a cover (9) covering the space (8) directly alongside the rail (2), which cover (9):

aa) is detachably connected to the support structure (7), such that in the installed state the cover (9) can be reversibly removed from the support structure (7), bb) has an essentially horizontal surface, which is essentially flush with the running surface (6) of the rail head (3), and cc) has an edge region (11) directed towards the rail (2), which forms a guide rail, c) an angled profile (10) which is generally L- or J-shaped in cross-section and is fixedly connected to the cover (9), or formed integrally with the cover (9), wherein the angled profile (10) has a first leg (19) extending in the direction of the rail foot (5), and a second leg (20) extending in the direction of the rail web (4), wherein the support structure (7), the cover (9) and the angled profile (10) are not attached to the rail (2), and d) a strand-shaped profiled filling element (100, 200, 220), wherein the strand-shaped profiled filling element (100, 200, 220) consists of an elastomeric material and contains at least one hollow channel (201, 221) extending in the longitudinal direction of the strand-shaped profiled filling element (100, 200, 220).

2. The rail assembly (1) according to claim 1, wherein the profiled filling element (100, 200, 220) is arranged on the second leg (20) extending in the direction of the rail web (4).

3. The rail assembly (1) according to claim 1, wherein the surface of the profiled filling element (200, 220) is essentially flush with the running surface (6) of the rail head (3).

4. The rail assembly (1) according to claim 1, wherein the profiled filling element (100, 200, 220) is attached to the generally L- or J-shaped angled profile (10).

5. The rail assembly (1) according to claim 2, wherein the profiled filling element (100, 200, 220) is attached to the generally L- or J-shaped angled profile (10) by screwing or gluing.

6. The rail assembly (1) according claim 1, wherein the support structure (7) has a rear wall (13) extending essentially parallel to the longitudinal direction of the rail, and transverse walls (25) directed transversely to the rear wall in the direction of the rail (2) and arranged at intervals from one another.

7. The rail assembly (1) according to claim 6, wherein the support structure (7) has openings (32) in the transverse walls (25).

8. The rail assembly (1) according to claim 1, wherein the support structure (7) has openings (32).

9. The rail assembly (1) according to claim 1, wherein the support structure (7) has a drainage fitting.

10. The rail assembly (1) according claim 1, wherein the strand shaped profiled filling element (100) fills the space between the angled profile (10) and the rail (2).

11. A rail assembly (1) for rail vehicles with flanged wheels (22), comprising:

a) at least one rail (2) of the Vignol type with a rail head (3), having a running surface (6) for a flanged wheel (22), a rail web (4) and a rail foot (5), b) a support structure (7), flanking the rail (2) laterally in the longitudinal direction of the rail, for a cover (9) covering the space (8) directly alongside the rail (2), which cover (9):

aa) is detachably connected to the support structure (7), such that in the installed state the cover (9) can be reversibly removed from the support structure (7), bb) has an essentially horizontal surface, which is essentially flush with the running surface (6) of the rail head (3), and cc) has an edge region (11) directed towards the rail (2), which forms a guide rail, c) an angled profile (10) which is generally L- or J-shaped in cross-section and is fixedly connected to the cover (9), or formed integrally with the cover (9), wherein the angled profile (10) has a first leg (19) extending in the direction of the rail foot (5), and a second leg (20) extending in the direction of the rail web (4), wherein the support structure (7), the cover (9) and the angled profile (10) are not attached to the rail (2), and d) a strand-shaped profiled filling element (100, 200, 220), wherein the profiled filling element (200, 220) is generally L- or J-shaped in cross-section and has a first profile leg (202, 222) extending in the direction of the rail foot (5), and a second profile leg (203, 223) extending in the direction of the rail web (4), and wherein the first profile leg (202, 222) contains at least one hollow channel (201, 221) extending in the longitudinal direction of the strand-shaped profiled filling element (200, 220), which is surrounded transversely to the longitudinal direction of the strand-shaped profiled filling element (200, 220) by a wall of profile material, and the second profile leg (203, 223) of the profiled filling element (200, 220) is of solid construction and forms a profiled filling element base.

12. A profiled filling element (200, 220) for a rail assembly (1) for rail vehicles with flanged wheels (22), the rail assembly (1) comprising:

a) at least one rail (2) of the Vignol type with a rail head (3), having a running surface (6) for a flanged wheel (22), a rail web (4) and a rail foot (5), b) a support structure (7), flanking the rail (2) laterally in the longitudinal direction of the rail, for a cover (9) covering the space (8) directly alongside the rail (2), which cover (9):

aa) is detachably connected to the support structure (7), such that in the installed state the cover (9) can be reversibly removed from the support structure (7), bb) has an essentially horizontal surface, which is essentially flush with the running surface (6) of the rail head (3), and cc) has an edge region (11) directed towards the rail (2), which forms a guide rail, c) an angled profile (10) which is generally L- or J-shaped in cross-section and is fixedly connected to the cover (9), or formed integrally with the cover (9), wherein the angled profile (10) has a first leg (19) extending in the direction of the rail foot (5), and a second leg (20) extending in the direction of the rail web (4), wherein the support structure (7), the cover (9) and the angled profile (10) are not attached to the rail (2), wherein the profiled filling element (200, 220) has a strand-shaped form, and generally has an L- or J-shaped cross-section, and wherein a first profile leg (202, 222) contains at least one hollow channel (201, 221) extending in the longitudinal direction of the strand-shaped profiled filling element (200, 220), which is surrounded by profile material transversely to the longitudinal direction of the extruded profiled filling element (200, 220), and a second profile leg (203, 223) of the profiled filling element (200, 220) is of solid construction.

13. The profiled filling element (200, 220) according to claim 12, wherein the first profile leg (202, 222) comprises a section (204, 224) with a protrusion (206, 226), which projects in the direction in which the second profile leg (203, 223) extends, and wherein at least a part of the at least one hollow channel (201, 221) is located in the section (204, 224) with the protrusion (206, 226).

14. The profiled filling element (200, 220) according to claim 13, wherein the section (201, 224) with the protrusion (206, 226) is arranged such that in the installed state the protrusion (206, 226) can be brought into engagement with the underside of the rail head of a Vignol-type rail (2).

15. The profiled filling element (200, 220) according to claim 12, wherein the profile material laterally surrounding the at least one hollow channel (201, 221) in the first profile leg (202, 222) forms a first lateral profile leg wall (207, 227) facing the side with the second profile leg (203, 223), and an opposing second lateral profile leg wall (208, 228), wherein the first lateral profile leg wall (207, 227) in cross-section is zigzag-shaped such that the protrusion (206, 226) is thereby formed, and wherein the inner wall surfaces (209, 229) of the at least one hollow channel (201, 221), located towards the first lateral profile leg wall (207, 227) in the section (204, 224) with the protrusion (206, 226), extend essentially parallel to the outer wall surfaces (211), 231) of the first lateral profile leg wall (207, 227), such that the first lateral profile leg wall (207, 227) has essentially the same wall thickness in the section (204, 224) with the protrusion (206, 226).

16. The profiled filling element (200, 220) according to claim 15, wherein a single hollow channel (201, 221) is arranged in the first profile leg (202, 222), such that the wall part (205, 225) located towards the free end of the first profile leg (202, 222) has a greater wall thickness than the first lateral profile leg wall (207, 227), also the second lateral profile leg wall (208, 228) extends with a zigzag-shaped cross-section, and the inner wall surfaces (209, 229, 210, 230) of the one hollow channel (201, 222) in the section with the protrusion (206, 226) extend essentially parallel to the respective outer wall surfaces (211, 212; 231, 232) of the first and second lateral profile leg walls (207, 227; 208, 228), such that the first and second lateral profile leg walls (207, 227; 208, 228) in the section (204, 224) with the protrusion (206, 226) in each case have an essentially uniform wall thickness.

17. The profiled filling element (200, 220) according to claim 12, wherein the design of the profiled filling element (200, 220) is generally L-shaped in cross-section.

18. The profiled filling element (200, 220) according to claim 12, wherein the profiled filling element (200, 220) consists of an elastomeric material.

* * * * *